US007474268B2

(12) United States Patent
Cheng et al.

(10) Patent No.: US 7,474,268 B2
(45) Date of Patent: Jan. 6, 2009

(54) COUPLING ANTENNA DEVICE HAVING ANTENNA PATTERN WITH MULTI-FREQUENCY RESONATING SECTORS

(75) Inventors: Yu-Chiang Cheng, Taipei (TW); Ping-Cheng Chang, Chaozhou Town (TW); Cheng-Zing Chou, Xinying (TW)

(73) Assignee: Mitac Technology Corp., Hsin-Chu Hsien (TW)

( * ) Notice: Subject to any disclaimer, the term of this patent is extended or adjusted under 35 U.S.C. 154(b) by 241 days.

(21) Appl. No.: 11/404,809

(22) Filed: Apr. 17, 2006

(65) Prior Publication Data

US 2007/0210963 A1 Sep. 13, 2007

(30) Foreign Application Priority Data

Mar. 7, 2006 (TW) ..... 95107646 A

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 767
See application file for complete search history.

(56) References Cited

U.S. PATENT DOCUMENTS

| | | | | |
|---|---|---|---|---|
| 3,131,394 | A * | 4/1964 | Wheeler | 343/895 |
| 6,424,309 | B1 * | 7/2002 | Johnston et al. | 343/767 |
| 6,680,705 | B2 * | 1/2004 | Tan et al. | 343/702 |
| 7,233,294 | B2 * | 6/2007 | Fang | 343/702 |
| 2005/0280580 | A1 * | 12/2005 | Lin | 343/700 MS |

OTHER PUBLICATIONS

Wong, K., et al.; "Broad-Band Single-Patch Circularly Polarized Microstrip Antenna with Dual Capacitively Coupled Feeds"; IEEE Transactions on Antennas and Propagation; vol. 49, No. 1, Jan. 2001; pp. 41-44.

* cited by examiner

*Primary Examiner*—Shih-Chao Chen
(74) *Attorney, Agent, or Firm*—Quintero Law Office

(57) ABSTRACT

Disclosed is a coupling antenna device for transceiving a plurality of wireless signals with multiple radiation frequencies. The coupling antenna device includes an antenna pattern having a plurality of adjacent resonating sectors, each of the resonating sectors having a length determined by a specific radiation frequency responsive to one of the wireless signals.

14 Claims, 6 Drawing Sheets

COUPLING ANTENNA DEVICE HAVING ANTENNA PATTERN WITH MULTI-FREQUENCY RESONATING SECTORS

FIELD OF THE INVENTION

The present invention relates to an antenna device used in wireless technology, and in particular to a coupling antenna device having an antenna pattern with multi-frequency resonating sectors.

BACKGROUND OF THE INVENTION

It is well known that an antenna is the key element to transmit/receive (transceive) microwaves in wireless technology such as wireless communication and wireless data transfer, where the antenna transforms electrical currents generated by a transmitter into microwaves and transmits the microwaves in free space. The antenna also captures microwaves and transforms them into electrical currents, which are then processed by a receiver.

There are two means to conduct signals between a transmitter/receiver (transceiver) and an antenna, and they are wire connecting and coupling feeding. Electrically connecting the transceiver and the antenna directly with an antenna signal feeding line is known as the wire connecting method, while electrically connecting the transceiver and an antenna-coupling element with the antenna signal feeding line is known as the coupling feeding method.

Further, in the method of coupling feeding the antenna is electrically connected neither to the antenna-coupling element nor the antenna signal feeding line. Since the antenna and the antenna-coupling element could be arranged in different and separate layers/positions, and sometimes further provided with a separating medium arranged in between, the coupling feeding method has more advantages than the method of wire connecting.

Such advantages includes the decrease of coupling effect between the antenna and the antenna signal feeding line (such effect is the cause of noises), the isolation of parasitic radiation from the feeding end, which electrically connects the antenna and the antenna signal feeding line, and the apply of the appropriate substrate matter to the antenna and the antenna signal feeding line respectively to increase the bandwidth of the antenna.

As stated previously, a microwave is basically the alteration between electric and magnetic field in free space. The presence of the antenna causes an alteration of the electric field, and the dimension of the antenna predetermined the alteration of the electric field and the microwave that it responds to. Take a dipole antenna and a PIFA antenna for example, the overall length of the dipole antenna is approximately half the wavelength of the microwave it responds to, while the overall length of the PIFA antenna is approximately one fourth of the wavelength the microwave it responds to.

Therefore, since an antenna with certain dimension used in for example an electronic device is to respond to certain microwave, the antenna is to transceive certain frequency of wireless signals, and that limits the use of both the electronic device and the antenna.

SUMMARY OF THE INVENTION

A primary object of the present invention, therefore, is to provide a coupling antenna device having an antenna pattern with multi-frequency resonating sectors to enable the coupling antenna device to respond to and transceive a plurality of wireless signals with multiple radiation frequencies so that the antenna device is capable of the transceiving of microwaves with different radiation frequencies.

Another object of the present invention is to provide an antenna pattern, used in electronic devices, with multi-frequency resonating sectors, so that the electronic devices are able to transceive a plurality of wireless signals with multiple radiation frequencies.

To realize the above objects, the present invention installs a coupling antenna device for transceiving a plurality of wireless signals, and the antenna device includes an antenna pattern having a plurality of adjacent resonating sectors, each of the sectors having a length determined by a specific radiation frequency responsive to one of the wireless signals.

The antenna device also includes an antenna-coupling element and an antenna signal feeding line, wherein the antenna-coupling element is arranged at a coupling position corresponding to the antenna pattern with a predetermined distance therebetween for coupling the wireless signals transceived by the antenna pattern, and the antenna signal feeding line is electrically connected to the antenna-coupling element to feed the wireless signal transceived by the antenna pattern through the coupling of the antenna-coupling element.

In comparison with the conventional technologies, the present invention enables the antenna and the electronic device equipped with the antenna to respond to and to transceive a plurality of wireless signals with multiple radiation frequencies.

These and other objects, features and advantages of the invention will be apparent to those skilled in the art, from a reading of the following brief description of the drawings, the detailed description of the first embodiment, and the appended claims.

BRIEF DESCRIPTION OF THE DRAWINGS

The structure and the technical means adopted by the present invention to achieve the above and other objects can be best understood by referring to the following detailed description of the first embodiments and the accompanying drawings, wherein.

DETAILED DESCRIPTION OF THE FIRST EMBODIMENTS

Figure 1:
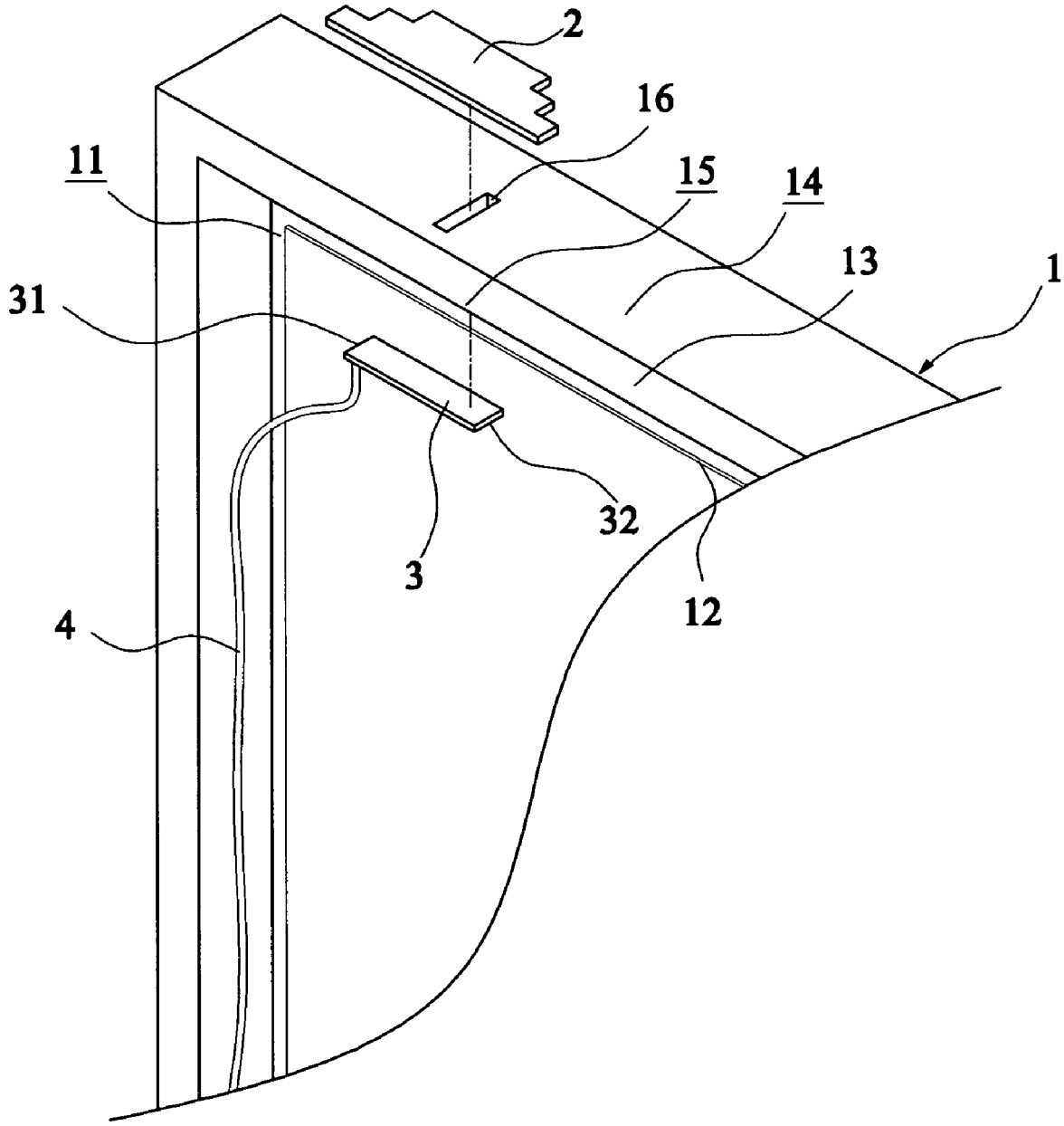
FIG. 1 is an exploded perspective view of a coupling antenna device having an antenna pattern with multi-frequency resonating sectors in accordance with a first embodiment of the present invention.
Figure 2:
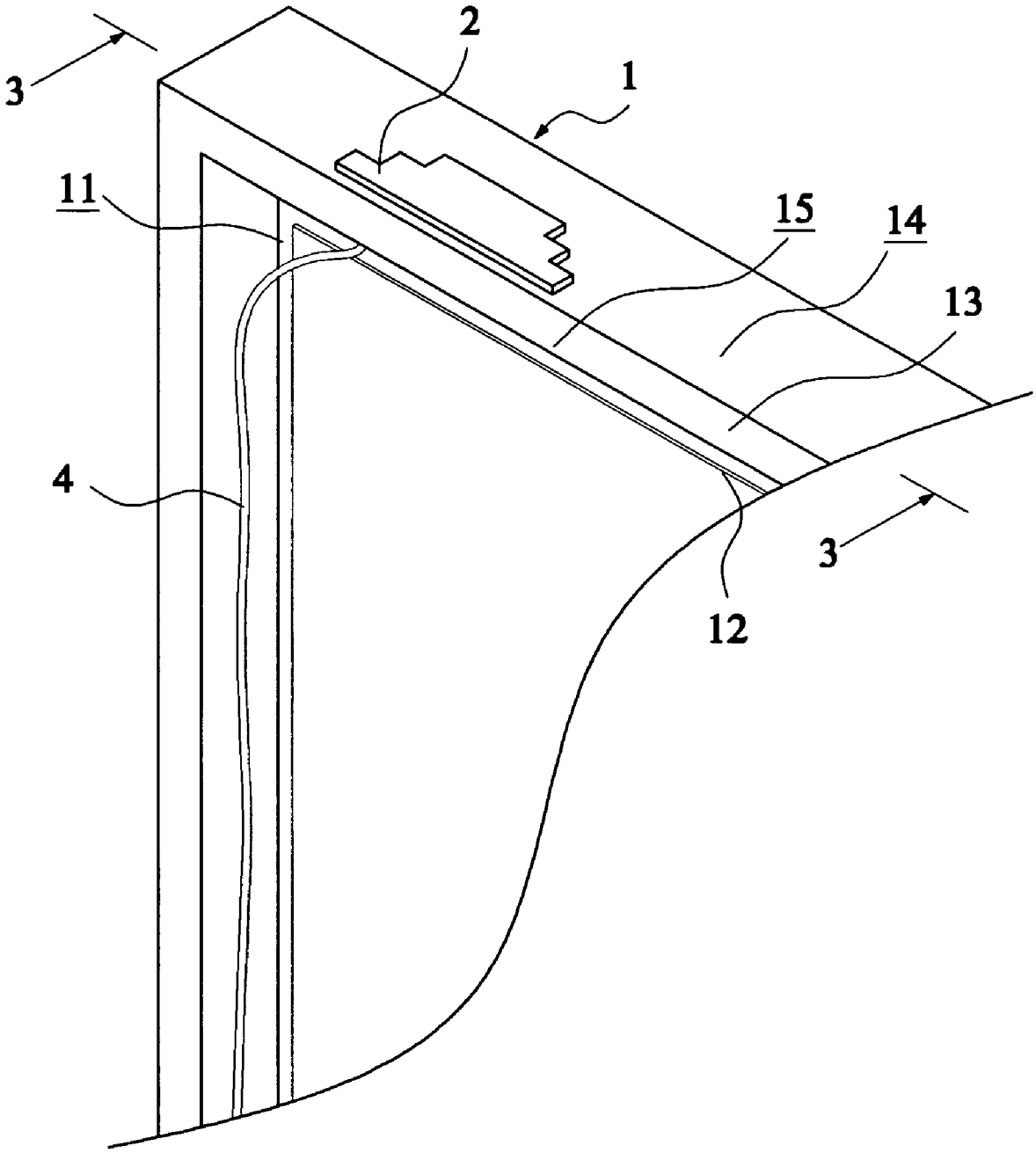
FIG. 2 is an assembled perspective view of FIG. 1.
Figure 3:
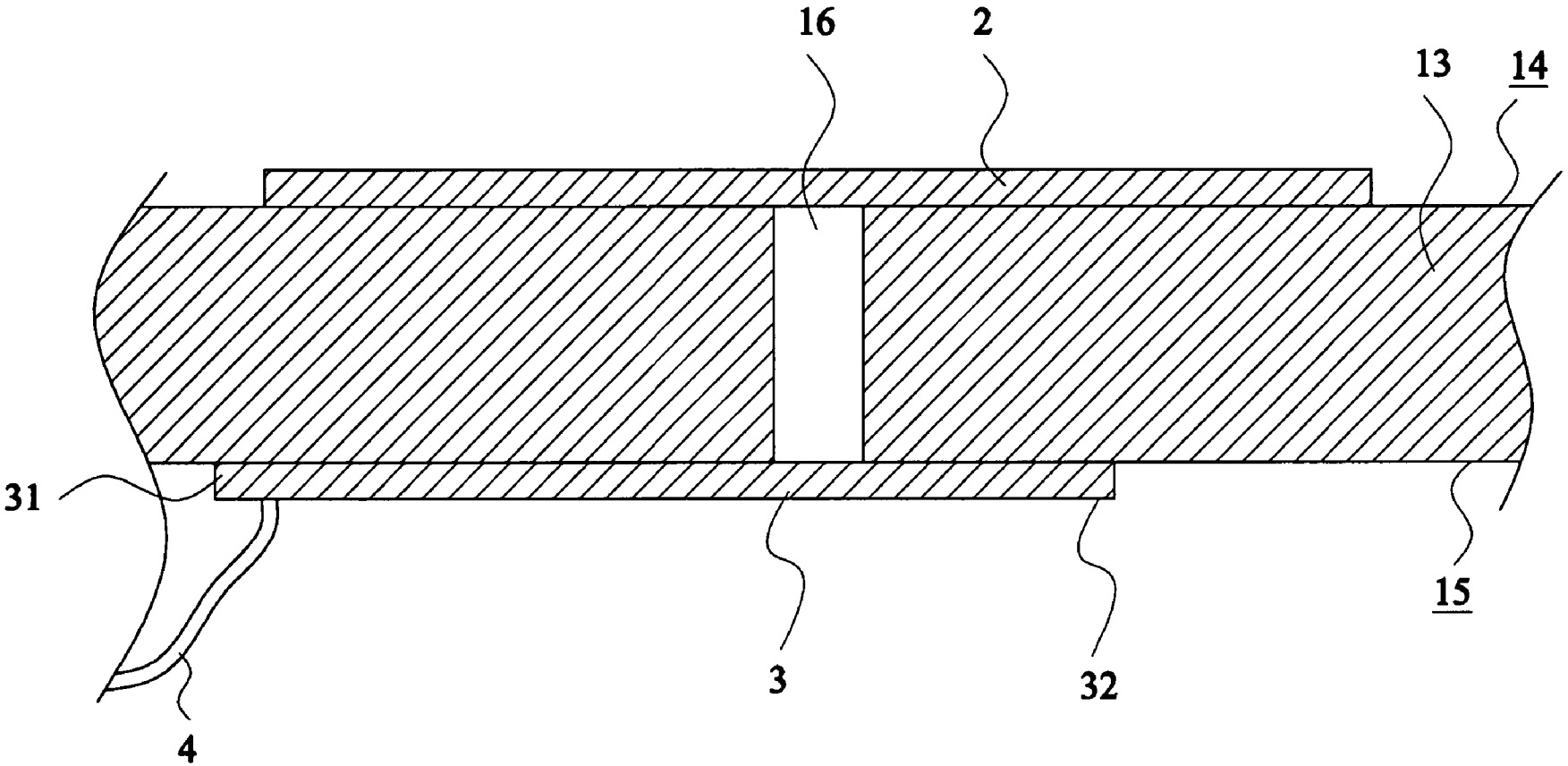
FIG. 3 is a sectional view taken along line 3-3 of FIG. 1.

With reference to the drawings and in particular to FIGS. 1 and 2 that are exploded and assembled perspective views, respectively, of a coupling antenna device in accordance with a first embodiment of the present invention, and to FIG. 3 that is a sectional view taken along line 3-3 of FIG. 1. As shown in the figures an electronic device, which is generally denoted a numeral reference 1, includes an antenna pattern 2, and an antenna-coupling element 3 is arranged at a coupling position corresponding to the antenna pattern 2 with a predetermined distance therebetween for coupling the wireless signals transceived by the antenna pattern 2. Further, the antenna-coupling element 3 is electrically connected to the electronic device 1 by an antenna signal feeding line 4.

The electronic device 1 defines an inner surface 11, and an anti-EMI plate 12 is mounted thereon. The antenna-coupling element 3 is provided with a signal feeding end 31 and a signal-coupling end 32, which is capable of coupling with the antenna pattern 2. The wireless signals transceived by the antenna pattern 2 can be transmitted to the electronic device 1 through the antenna signal feeding line 4.

The anti-EMI plate 12 functions as the protection of the electronic device 1 from possible electromagnetic interference (EMI). The signal feeding end 31 connects the antenna-coupling element 3, while the antenna signal feeding line 4 and the signal-coupling end 32 couple with the antenna pattern 2, so that both the electric current generated by the transceiver (not shown in figure) is able to conduct to the antenna-coupling element 3 and the electric current generated by the antenna pattern 2, which is caused by the microwave the antenna pattern 2 captures, is capable of conducting to the transceiver.

Besides, a separating medium 13 is arranged between the antenna pattern 2 and the antenna-coupling element 3. It would be obvious to a person of ordinary skill in the art that the separating medium 13 could either be air, an insulating material, or the casing of the electronic device 1.

In the first embodiment of the present invention, the separating medium 13 is the casing of the electronic device 1, and the antenna pattern 2 is arranged on a top surface 14 of the separating medium 13, while the antenna-coupling element 3 is arranged on a bottom surface 15 of the separating medium 13. Furthermore, the casing of the electronic device 1 is formed with a through hole 16 arranged between the antenna pattern 2 and the antenna-coupling element 3.

In the present invention, the dimension and the position of the through hole 16 is adjusted to an optimum by such parameters as the thickness of the separating medium 13, the dimension of the antenna pattern 2, and that of the antenna-coupling element 3 as well. Such adjustment optimizes the coupling efficiency between the antenna pattern 2 and the antenna-coupling element 3, so that the transceiving of wireless signals of the antenna pattern 2 reaches the most efficiency. Moreover, the through hole 16 is responsible for the decrease of the coupling effect between the antenna pattern 2 and the antenna signal feeding line 4 (such coupling effect is one of the main causes of noises, hence not desirable.)

Figure 4:
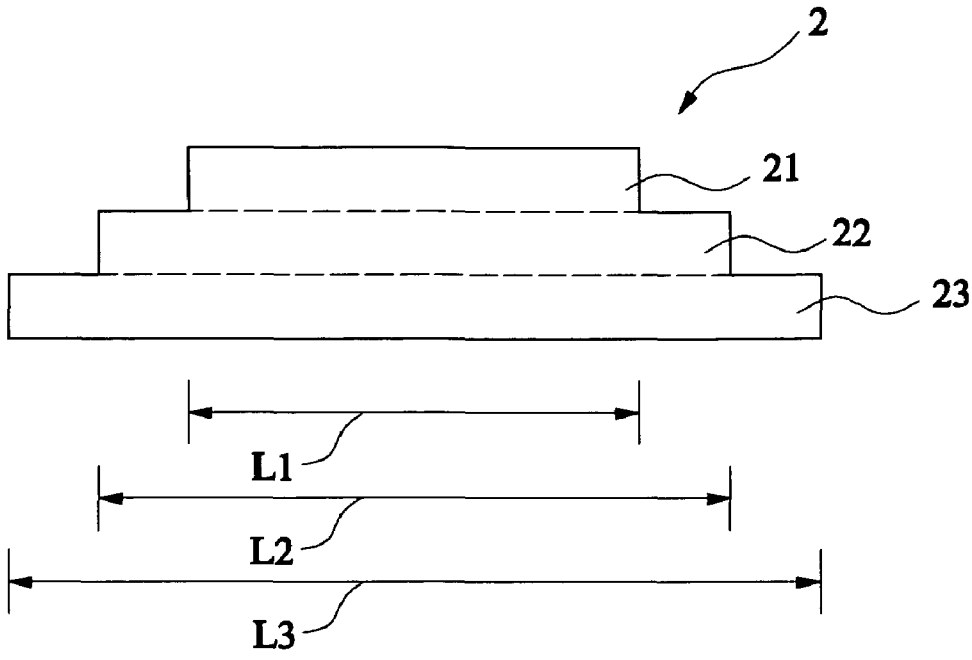
FIG. 4 shows an antenna pattern with multi-frequency resonating sectors of the coupling antenna device in accordance with the first embodiment.

FIG. 4 shows an antenna pattern with multi-frequency resonating sectors of the coupling antenna device in accordance with the first embodiment. As shown in the figure, the antenna pattern 2 is provided with multiple resonating sectors 21, 22, and 23, and that each of which shares different dimensions; that is, the resonating length L1 of the resonating sector 21 differs from the resonating length L2 of the resonating sector 22, which also differs from the resonating length L3 of the resonating sector 23.

As discussed in the background of the invention, an antenna with certain dimension is to respond to and to transceive certain wireless signals. In the first embodiment of the present invention, however, the antenna pattern 2 is provided with multiple resonating sectors 21, 22, and 23 with different resonating lengths L1, L2, and L3, and that each of the resonating lengths is determined by a specific radiation frequency corresponding to one of the wireless signals. As a consequence, the antenna pattern 2 of the present invention is able to respond to and transceive a plurality of wireless signals with multiple frequencies.

Figure 5:
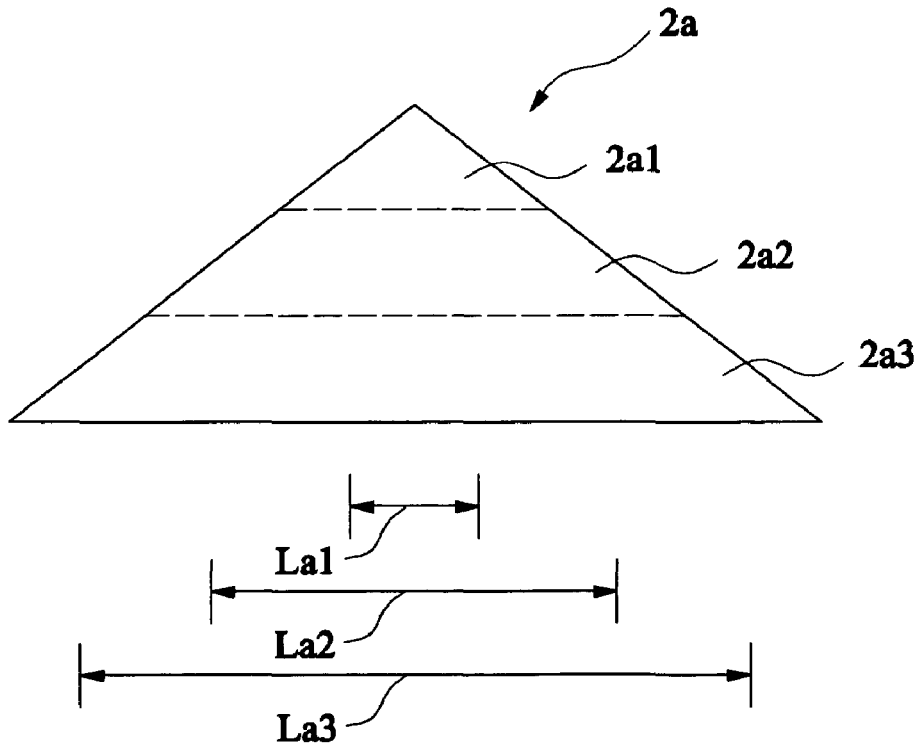
FIG. 5 shows an antenna pattern of a coupling antenna device having an antenna pattern with multi-frequency resonating sectors in accordance with a second embodiment of the present invention.

Please refer to FIGS. 5 to 9 that are antenna patterns, respectively, of the coupling antenna device having an antenna pattern with multi-frequency resonating sectors in accordance with different embodiments of the present invention. As shown in FIG. 5, an antenna pattern 2*a*, in a form of a triangular pattern, is provided with multiple adjacent resonating sectors 2*a*1, 2*a*2, and 2*a*3 with different resonating lengths La1, La2, and La3.

Figure 6:
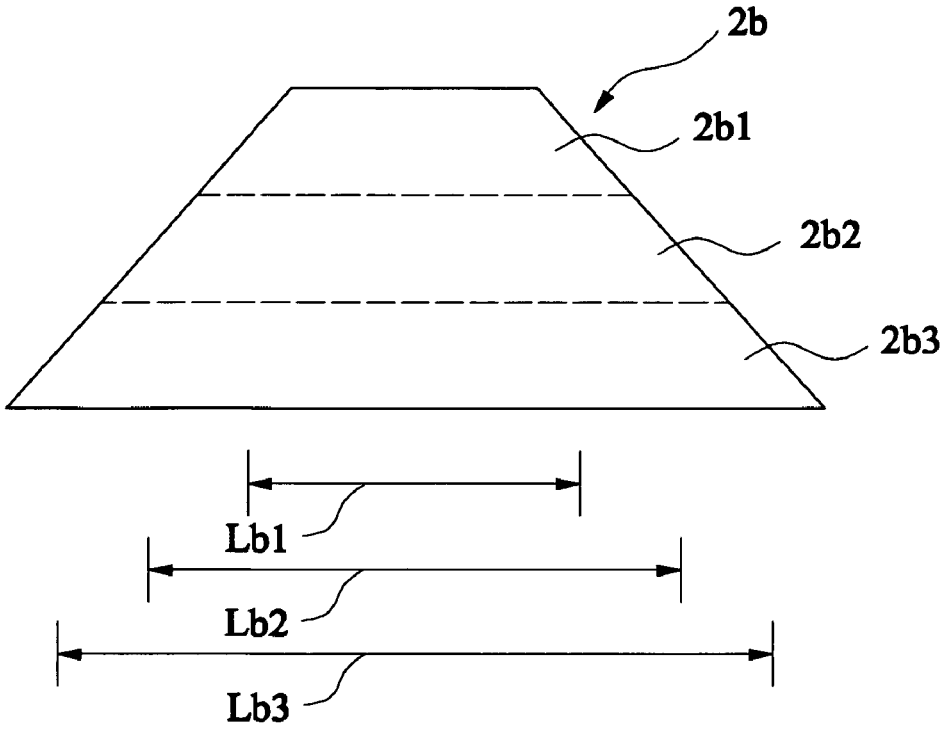
FIG. 6 shows an antenna pattern of the coupling antenna device having an antenna pattern with multi-frequency resonating sectors in accordance with a third embodiment of the present invention.
Figure 7:
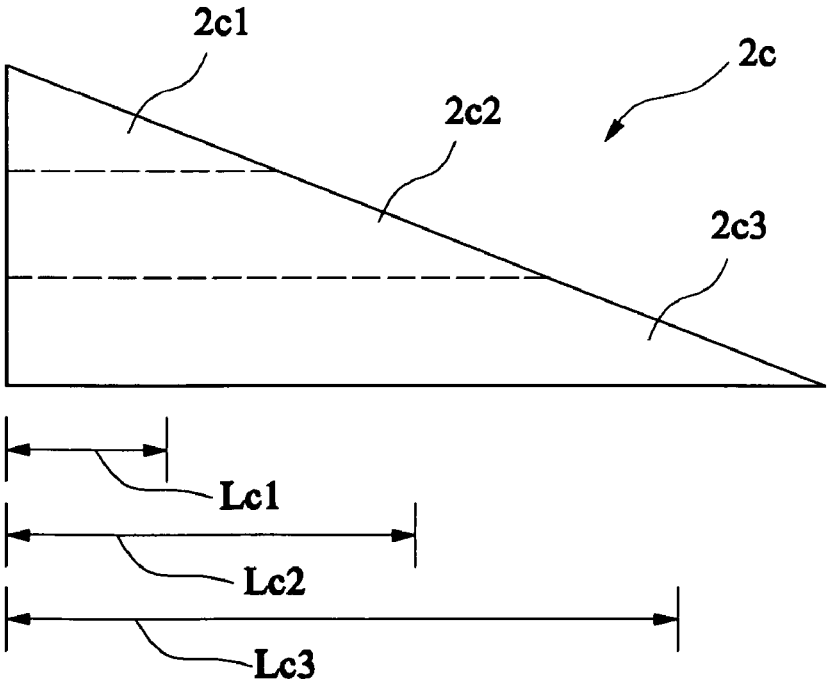
FIG. 7 shows an antenna pattern of the coupling antenna device having an antenna pattern with multi-frequency resonating sectors in accordance with a forth embodiment of the present invention.

FIG. 6 shows an antenna pattern 2*b*, which is in a form of a trapezoidal pattern, is provided with multiple adjacent resonating sectors 2*b*1, 2*b*2, and 2*b*3 with different resonating lengths Lb1, Lb2, and Lb3, while an antenna pattern 2*c*, in a form of a right triangular pattern, is provided with multiple adjacent resonating sectors 2*c*1, 2*c*2, and 2*c*3 with different resonating lengths Lc1, Lc2, and Lc3 is shown in FIG. 7.

Figure 8:
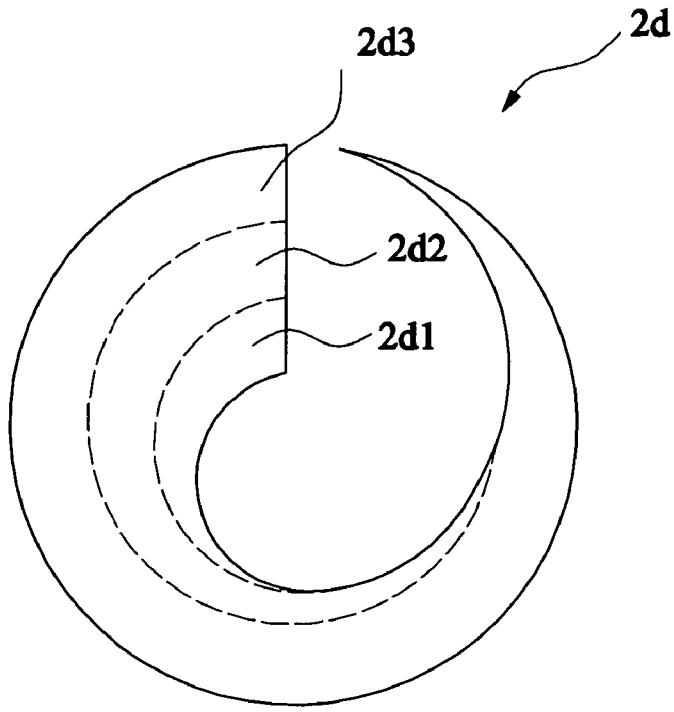
FIG. 8 shows an antenna pattern of the coupling antenna device having an antenna pattern with multi-frequency resonating sectors in accordance with a fifth embodiment of the present invention.
Figure 9:
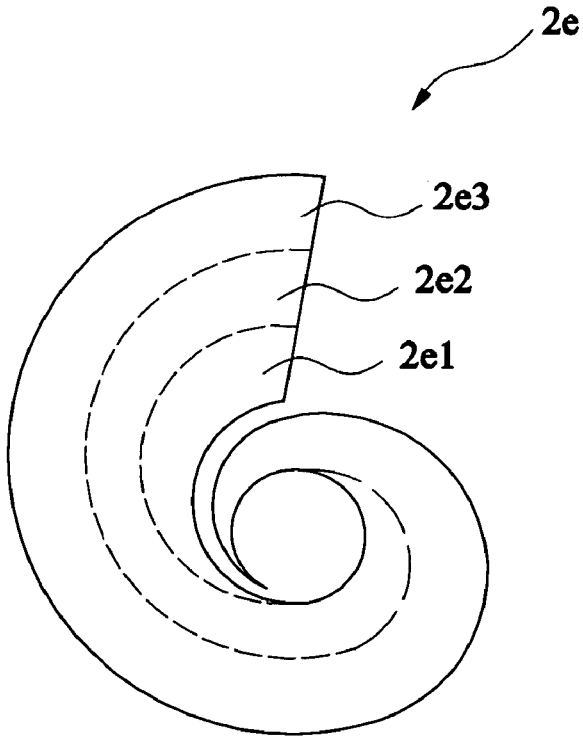
FIG. 9 shows an antenna pattern of the coupling antenna device having an antenna pattern with multi-frequency resonating sectors in accordance with a sixth embodiment of the present invention

Further, an antenna pattern 2*d* in a form of a spiral-like pattern, which is a curved right triangle, provided with multiple adjacent resonating sectors 2*d*1, 2*d*2, and 2*d*3 with different resonating lengths is shown in FIG. 8. FIG. 9 shows an antenna pattern 2*e* in a form of a nautilus-like pattern, which is also a curved right triangle, provided with multiple adjacent resonating sectors 2*e*1, 2*e*2, and 2*e*3 as well.

Unlike the antenna device of prior art, the coupling antenna device of the present invention is equipped with an antenna pattern having multi-frequency resonating sectors, each of which is capable to respond to a specific radiation frequency corresponding to one of the wireless signals. When it comes to transmitting wireless signals, it is possible to control the specific radiation frequency the antenna pattern transmits by controlling the resonating sectors the antenna-coupling element coupled. Moreover, the antenna pattern is able to respond to and receive wireless signals of specific radiation frequency with different resonating sectors.

Since the multiple resonating sectors 21, 22, etc., of the antenna patterns 2, 2*a*, etc., are mainly used as means to respond to and consequently to transceive wireless signals of different and predetermined radiation frequencies, it is understood that any other pattern with any other figure, structure, and dimension is functionally equivalent to the antenna patterns 2, 2*a*, etc., can be used in the present invention to replace the antenna patterns 2, 2*a*, etc. In addition, it would be obvious to anyone skilled in the art that the structure, dimension, figure and application field of the electronic device may be the determination of the choice of different antenna patterns from different embodiments of the present invention.

From the embodiments of the present invention stated above, the present invention enables the antenna device and the electronic device, in the preferred embodiment a portable computer, equipped with the same to transceive a plurality of wireless signals with multiple frequencies.

While the invention has been described in connection with what is presently considered to the most practical and first embodiments, it is to be understood that the invention is not to be limited to the disclosed embodiments, but on the contrary, is intended to cover various modifications and equivalent arrangement included within the spirit and scope of the appended claims.

What is claimed is:

1. A coupling antenna device, comprising:

an antenna pattern having a plurality of adjacent resonating sectors for transceiving a plurality of wireless signals, each of the resonating sectors having a length determined by a specific radiation frequency responsive to one of the wireless signals;

an antenna-coupling element arranged at a coupling position corresponding to the antenna pattern with a predetermined distance therebetween for coupling the wireless signals transceived by the antenna pattern;

a separating medium arranged between the antenna pattern and the antenna-coupling element, the separating medium comprises a plate made of an electric insulating material, the plate being formed with at least a through hole communicating the antenna pattern and the antenna-coupling element; and an antenna signal feeding line connected to the antenna-coupling element to feed the wireless signals coupled by the antenna-coupling element.

2. The coupling antenna device as claimed in claim 1, wherein the antenna pattern is imperforate and in a form of a triangular pattern.

3. The coupling antenna device as claimed in claim 1, wherein the antenna pattern is imperforate and in a form of a trapezoidal pattern.

4. The coupling antenna device as claimed in claim 1, wherein the antenna pattern is imperforate and in a form of a multilateral trapezoidal pattern.

5. The coupling antenna device as claimed in claim 1, wherein the adjacent resonating sectors of the antenna pattern are contiguous one with respect to another and in a form of a spiral-like pattern.

6. The coupling antenna device as claimed in claim 1, wherein the adjacent resonating sectors of the antenna pattern are contiguous one with respect to another and in a form of a nautilus-like pattern.

7. An antenna pattern for transceiving a plurality of wireless signals, comprising a plurality of adjacent resonating sectors disposed contiguously one with respect to another, each of the resonating sectors having a length determined by a specific radiation frequency responsive to one of the wireless signals, further comprising:

an antenna-coupling element arranged at a coupling position corresponding to the antenna pattern with a predetermined distance therebetween for coupling the wireless signals transceived by the antenna pattern;

an antenna signal feeding line connected to the antenna-coupling element to feed the wireless signals coupled by the antenna-coupling element; and an electrically insulating separating medium disposed between the antenna pattern and the antenna-coupling element, the separating medium having at least a through hole formed therein for providing open communication between the antenna pattern and the antenna-coupling element therethrough.

8. The antenna pattern as claimed in claim 7, wherein the antenna pattern is arranged on a casing of an electronic device.

9. The antenna pattern as claimed in claim 8, wherein the electronic device is a portable computer.

10. The antenna pattern as claimed in claim 7, wherein the antenna pattern is imperforate and in a form of a triangular pattern.

11. The antenna pattern as claimed in claim 7, wherein the antenna pattern is imperforate and in a form of a trapezoidal pattern.

12. The antenna pattern as claimed in claim 7, wherein the antenna pattern is imperforate and in a form of a multilateral trapezoidal pattern.

13. The antenna pattern as claimed in claim 7, wherein the antenna pattern is in a form of a spiral-like pattern.

14. The antenna pattern as claimed in claim 7, wherein the antenna pattern is in a form of a nautilus-like pattern.

* * * * *